United States Patent [19]

Tohma

[11] 4,027,715

[45] June 7, 1977

[54] DOOR

[75] Inventor: Tsuyoshi Tohma, Yamatotakada, Japan

[73] Assignee: Tohma Kohan Kabushiki Kaisha, Yamatotakada, Japan

[22] Filed: Nov. 21, 1975

[21] Appl. No.: 634,063

[30] Foreign Application Priority Data

Nov. 25, 1974 Japan ..... 49-136912
Aug. 30, 1975 Japan ..... 50-105334

[52] U.S. Cl. ..... 160/181; 160/231 R; 160/352; 160/354

[51] Int. Cl.[2] ..... E05D 3/48

[58] Field of Search ..... 160/354, 133, 231 R, 160/231 A, 26, 34, 352, 181

[56] References Cited

UNITED STATES PATENTS

| | | | |
|---|---|---|---|
| 333,408 | 12/1885 | Hale | 160/231 R |
| 425,432 | 4/1890 | Joseph et al. | 160/231 R |
| 541,768 | 6/1895 | Lugrin | 160/133 |
| 2,054,499 | 9/1936 | Florman | 160/231 R UX |
| 2,783,833 | 3/1957 | Cann | 160/354 |
| 3,420,290 | 1/1969 | Dirubbo | 160/354 |
| 3,511,301 | 5/1970 | Graham et al. | 160/232 UX |

*Primary Examiner*—Philip C. Kannan
*Attorney, Agent, or Firm*—Bacon & Thomas

[57] ABSTRACT

A flexible door comprising a tough, nonelastic flexible sheet and a plurality of straight, plate-like unit blocks, each having a rectangular section and each being adhered to the sheet, the blocks being arranged side-by-side in contact with each other. The door is fixed to a post at one end and has a handle at the other end. When one side of the door formed by the unit blocks is pressed on, the side surfaces of adjacent unit blocks intimately contact each other, permitting the nonelastic sheet to keep the door planar in a closed position. When the handle on the other side, namely, on the sheet side, is pulled, the door flexes to an open position within a narrow space. The door can be installed in the same manner as a swing door without the necessity of providing a special guide and fixture on the lintel, floor, sill, etc.

8 Claims, 4 Drawing Figures

DOOR

BACKGROUND OF THE INVENTION

Swing doors heretofore used widely require a large space for opening because the door is opened with its full width turned about the support post. Accordingly, doors are known which comprise two or three unit segments each having a width one-half or one-third the width of the door and turnably connected together. When opened, the door flexes to a V-shape at the junctions of the adjacent segments, so that it has the advantage of reducing the shape needed for opening. However, this type of door is cumbersome to install, since the upper and lower ends of the door must be fitted in guide grooves formed in the lintel and sill so as to render the door moveable along the guide path.

Thus, with the doors other than swing doors which are made openable within a reduced space, it has been necessary to form the lintel and/or sill with a guide groove or special fixing means. Such doors, therefore, are unfit for home use.

SUMMARY OF THE INVENTION

An object of this invention is to provide a door comprising a nonelastic flexible sheet and a plurality of straight unit blocks having a quadrilateral section and fixed to one surface of the sheet, the blocks being arranged side-by-side in contact with each other, the door thus being rendered openable within a small space.

Another object of this invention is to provide a door of the type described which can be installed in place and which is openable within a small space merely by way of one of the end unit blocks being fixed to a support post and the other end unit block being provided with a handle, latch, lock and like members, without the necessity of forming a guide groove or special fixing structure in the lintel, sill, floor, etc.

DESCRIPTION OF THE PREFERRED EMBODIMENTS

Figure 1:
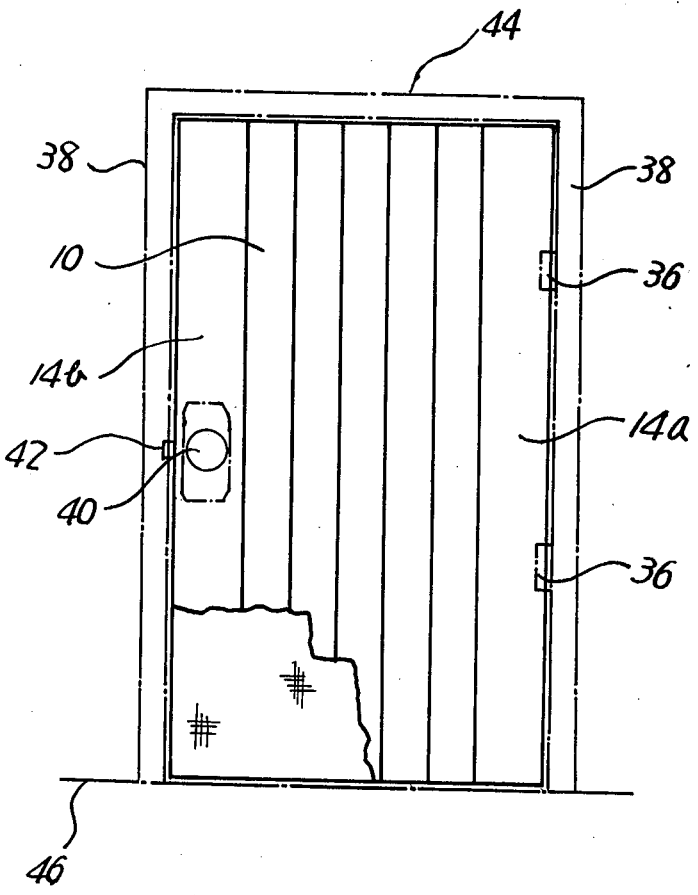
FIG. 1 is a front view of a door according to the present invention as installed between posts.

A door 10 according to the present invention comprises a tough, thin, flexible, substantially nonelastic sheet 12, such as sheet woven with nylon fibers, and straight unit blocks 14, each having a rectangular section and, each being fixed to one surface of the sheet 12, the blocks being arranged side-by-side in contact with each other. Each unit block 14 is a rigid body made of wood, plywood, composite wood plate, metal, synthetic resin or like hard material. As compared with the thickness of the sheet 12, the unit block 14 has a substantially greater thickness. When the sheet 12 is as thin as ordinary woven cloth, the unit block 14 is so dimensioned that it is 28 mm in thickness and 5 cm in width. Each unit block 14 may be in the form of a solid bar or hollow tube. The blocks 14 are fixed to the flexible sheet 12 with metal members or adhered thereto.

Backing plates 16 of the same width as, or of a smaller width than, the unit blocks 14 are adhered to the other surface of the tough flexible sheet 12 in opposing relation to the unit blocks 14. The opposite side edges of the backing plate 16 are inclined so that a V-shaped groove 18 is provided between the adjacent backing plates 16. The space or groove 18 serves to eliminate abutting contact between the side edges of adjacent backing plates 16 when the door 10 is bent or flexed inwardly. The backing plates 16 need not necessarily be provided; the door 10 is openable and closable without difficulty in the absence of the backing plates 16.

Since metal members must be fixed to the unit blocks **14*a* and 14*b* at the opposite ends of the door 10,** it is preferable that the end blocks have a greater width than the intermediate unit blocks and be filled with wood for reinforcement when they are of a hollow construction.

Figure 2:
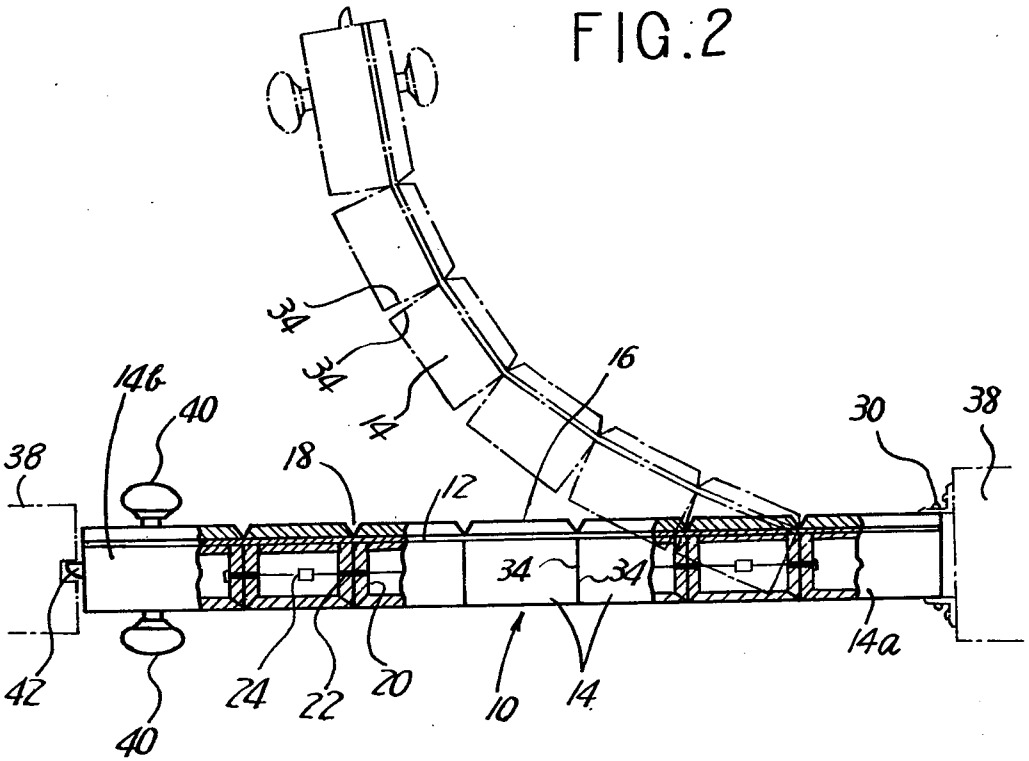
FIG. 2 is an enlarged plan view of the door of FIG. 1, the view being partly broken away to show the interior structure.

With the door shown in FIG. 2, the hollow unit blocks 14 are fitted with top covers to close the hollow interior. The side plates 20 of the unit blocks 14 are formed with aligned bores 22, through which extends elastic means 24 such as an elastic rubber string, spring or the like. The opposite ends of the elastic means are secured to the interior portions of end blocks **14*a* and 14*b* respectively. When the door is opened, the elastic means 24** is stretched at the same time, thereby imparting a restoring force to the door for closing. Alternatively, one elastic means may be provided for each unit block so as to urge the adjacent unit blocks toward each other when they are set apart.

Figure 3:
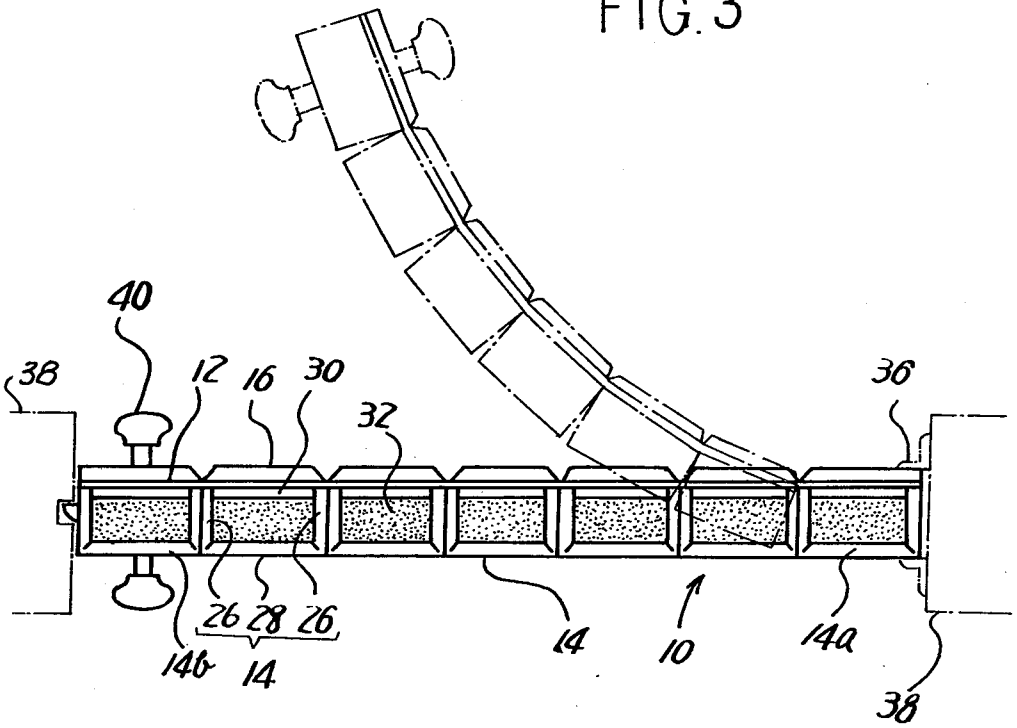
FIGS. 3 and 4, are plan views showing other embodiments respectively.

FIG. 3 shows another embodiment comprising unit blocks 14 each including a trough-like portion, i.e., opposite side plates 26 and an upper plate 28 integral therewith. To form each unit block 14, a bottom plate 30 is fitted in the trough to provide a hollow tube, around which a die is then fixedly fitted. The opposite open ends are thereafter closed, and styrol, urethane or like foamable synthetic resin composition is placed into the interior and is foamed to 2 to 100 times, preferably 20 to 25 times the original volume. By virtue of the foaming pressure, the foamed resin 32 penetrates even into the clearances between the side plates 26 and the bottom plate 30 fitted therebetween. The foamed resin solidifies in about 15 minutes and adheres the bottom plate 30 to the side plates 26 with its adhering properties. Thus the unit block 14 can be completed conveniently without the necessity of using fasteners or adhesive. Moreover, the foamed mass 32 completely filling the interior of the unit block 14 greatly enhances the strength of the unit block, eliminates dimensional irregulatities and gives the door an improved heat-insulating ability and higher soundproofing properties.

Figure 4:
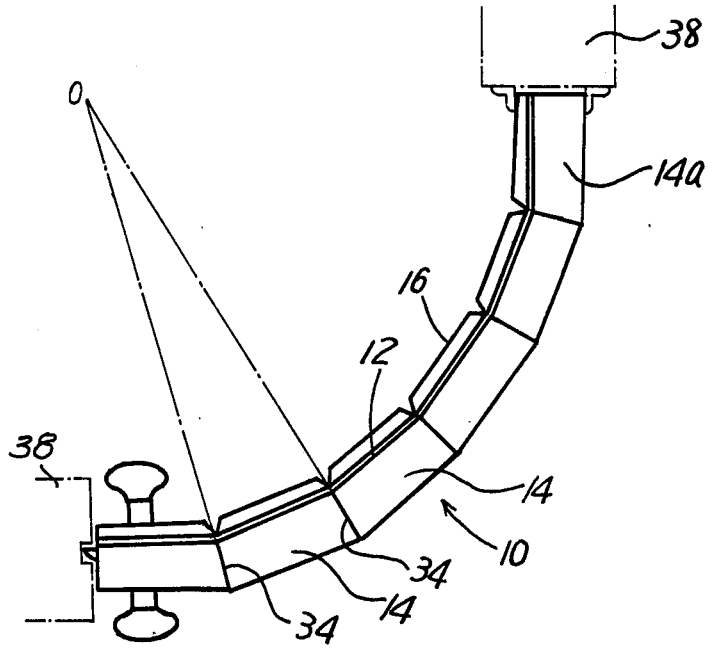

FIG. 4 shows another embodiment comprising unit blocks 14 each including opposite side walls 34 inclined symmetrically outwardly such that the bottom of the block in contact with the sheet 12 has a reduced width and the front thereof has an increased width. When the unit blocks 14 are fixed to the sheet 12 and arranged side-by-side in contact with each other, the door 10 thus obtained invariably assumes an outwardly bulged circular arc shape having a center O, the side walls 34 being so inclined as to be in alignment with the radial lines of the circular arc extending from its center O. Thus by suitably varying the degree of inclination of the side walls of each unit block, curved doors are easily and inexpensively available which have heretofore been difficult and costly to make. For example, if the side walls are inclined inwardly to make the width of the block greater toward the sheet 12 and smaller toward the outside, a door is obtained which has an inwardly curved outer surface.

The door 10 described above is fixedly provided, on the opposite surface of the end unit block 14*a*, with connecting members 36 which are secured to a post 38, with the sheet 12 facing toward the direction in which the door is opened. A handle 40, latch 42 and lock member are mounted on the other end unit block 14*b* which faces another post 38. Thus the door can be completely installed in place without the necessity of a special guide groove or fixing structure in the lintel 44, floor 46, sill, etc.

When pressure is applied to the door 10 on that side thereof defined by the unit blocks 14 (the door 10 being fitted between posts 38 and supported by the lintel 44 and retained in its closed position by the latch 42), the side walls 34 of each adjacent two unit blocks 14 come into intimate contact with each other, with the result that the substantially nonelastic sheet 12 keeps the door 10 planar and prevents warping, as if it were a single plate or board. Thus, the door remains closed, exhibiting high resistance to the pressure.

However, when the door is unlatched and is pulled toward the interior of the room by the handle 40 on the sheet side, each unit block 14 is released from the side wall 34 of the unit block 14 adjacent thereto, permitting the sheet 12 to flex between the two unit blocks 14. In this way the sheet progressively flexes between the unit blocks. Consequently the door flexes to an open position as if being rolled up as indicated in the dot-and-dash lines in FIGS. 2 and 3. The door is, therefore, openable and closable within a reduced space.

The smaller the width of the unit block, the more smoothly will the door be opened or closed. Furthermore, the greater the thickness of the unit block relative to the thickness of the sheet 12, the smaller will be the warping of the door when the door is in the closed position and is pressed on from the outside.

This invention is not limited to the foregoing description and illustration, but it will be of course easy for one skilled in the art to modify the invention variously. Such modifications are all included within the scope of this invention as defined in the appended claims.

What is claimed:

1. A door assembly comprising:

a. a pair of spaced, parallel, vertical posts;

b. a horizontal lintel and a spaced, parallel horizontal floor defining portion both of which extend between said posts; said lintel, said floor defining portion of said posts defining a door opening;

c. a door in said opening, said door including a tough, flexible, substantially non-elastic sheet and a plurality of vertical unit blocks fixed to one surface of said sheet and arranged in side-by-side relationship with each other, each of the unit blocks having a thickness substantially greater than the thickness of the flexible sheet:

d. said door having a first vertical door side closely adjacent to and parallel with one of said vertical posts and a second vertical door side closely adjacent to and parallel with the other of said vertical posts;

e. each of said unit blocks having vertical side surfaces the entireties of which are of a flat planar configuration, the side surfaces of adjacent unit blocks fully contacting each other when said door is in said closed position;

f. said unit blocks being arranged in a series, all of said unit blocks extending substantially the entire vertical length of said posts in parallel relationship therewith, a first unit block of said series being disposed immediately adjacent said one vertical post, one of said vertical side surfaces of said first unit block facing said one post and defining said first vertical door side, said door being fixedly connected with said one vertical post by connecting means, said connecting means being coupled with said door in the region of said first vertical door side;

g. said door being unconnected with said lintel and floor defining portion and being free to swing away therefrom during opening;

h. whereby said door may flex sideways toward said sheet to an open position while permitting each of the unit blocks to move out of contact with the side surface of each adjacent unit block, the door being retainable in its closed position by each of the unit blocks coming into intimate fitting contact with the side surface of each adjacent unit block to prevent the door from warping.

2. A door as defined in claim 1 wherein the side surfaces of each of the unit blocks are parallel to each other and perpendicular to the flexible sheet, and wherein the door and sheet are substantially planar when the door is closed.

3. A door as defined in claim 1 wherein the side surfaces of each of the unit blocks are inclined with respect to the flexible sheet and the door has a curved configuration when closed.

4. A door as defined in claim 1 wherein the unit blocks are each in the form of a hollow tube.

5. A door as defined in claim 4 wherein the unit blocks are each filled with a synthetic resin in the interior of each hollow tube.

6. A door as defined in claim 1 including elastic means extending transversely through the unit blocks and connecting the unit blocks together to impart a restoring force to the door.

7. A door as defined in claim 1 including straight, strip-like backing plates having a width not greater than the width of the unit blocks, said backing plates being adhered to the other surface of the flexible sheet.

8. A door as defined in claim 1, including a last unit block of said series, said last unit block being provided with a latch and a handle.

* * * * *